US006179280B1

(12) United States Patent
Coppolo et al.

(10) Patent No.: US 6,179,280 B1
(45) Date of Patent: Jan. 30, 2001

(54) ENVELOPE PROCESSING APPARATUS

(76) Inventors: Andrew F. Coppolo, 58 S. Valley Rd., West Orange, NJ (US) 07052; Ross F. Morrone, 22 Hamilton Ave., Cranford, NJ (US) 07016

( * ) Notice: Under 35 U.S.C. 154(b), the term of this patent shall be extended for 0 days.

(21) Appl. No.: 09/330,759

(22) Filed: Jun. 11, 1999

(51) Int. Cl.[7] ..... B65H 5/02; B54B 43/26

(52) U.S. Cl. ..... 271/2; 271/5; 271/6; 53/382.1

(58) Field of Search ..... 271/2, 5, 6; 53/492, 53/460, 381.7, 382.1, 382.2; 493/245, 450, 453, 455, 460

(56) References Cited

U.S. PATENT DOCUMENTS

| | | | |
|---|---|---|---|
| 1,481,557 | 1/1924 | Post . | |
| 1,877,842 | 9/1932 | Gay . | |
| 1,918,425 | 7/1933 | Pride . | |
| 1,986,800 | 1/1935 | Elliott . | |
| 2,038,645 | 4/1936 | Cherry et al. . | |
| 2,130,101 | 9/1938 | Ritzerfeld . | |
| 2,214,265 | 9/1940 | Wuille . | |
| 2,554,577 | 5/1951 | Lauffer . | |
| 2,554,578 | 5/1951 | Lauffer . | |
| 3,162,435 | * 12/1964 | Rastorguyeff et al. | 271/2 |
| 3,175,822 | 3/1965 | Benson . | |
| 3,281,142 | 10/1966 | Treff . | |
| 3,323,792 | 6/1967 | Hartzell . | |
| 3,450,307 | 6/1969 | Sutton . | |
| 3,549,067 | 12/1970 | Robbins . | |
| 3,583,124 | 6/1971 | Morrison . | |
| 3,586,312 | 6/1971 | Sammons . | |
| 3,828,634 | 8/1974 | Luperti . | |
| 4,020,615 | 5/1977 | Irvine et al. . | |
| 4,362,100 | 12/1982 | Wu et al. . | |
| 4,371,157 | 2/1983 | Hunt et al. . | |
| 4,431,323 | 2/1984 | Kulow . | |
| 4,522,382 | 6/1985 | Chu et al. . | |
| 4,540,298 | 9/1985 | Kulow . | |
| 4,551,188 | * 11/1985 | Schulze | 53/381.7 |
| 4,603,846 | 8/1986 | Miles . | |
| 4,776,152 | 10/1988 | Kruk . | |

(List continued on next page.)

*Primary Examiner*—John M. Jillions
(74) *Attorney, Agent, or Firm*—Sperry, Zoda & Kane

(57) ABSTRACT

An apparatus for automatically closing and/or opening of the envelope closing flap for any sized envelope when stacked together. This device makes use of a vacuum transfer device using suction cups along with a drive roller and camming device for selectively gripping and moving individual envelopes through the system. The envelopes, if open, will be stacked upright in a feed tray and, if closed, will be stacked inverted in the feed tray and will be passed to two main drive rollers as a burst of air is emitted from a wedge to change the orientation of the closing flap from a first position to a second position. This can be used for opening or closing of such flaps. The device also includes a housing with multiple rollers powered therein along with a connecting rod assembly and cam member for selectively supplying vacuum to the pivotally movable suction powered vacuum transfer device. A delivery assembly preferably including two rollers and a drive belt connected therebetween will transfer the processed envelopes toward an exit station where they will be stacked preferably vertically.

20 Claims, 4 Drawing Sheets

U.S. PATENT DOCUMENTS

| | | | | |
|---|---|---|---|---|
| 4,813,209 | * | 3/1989 | Foster et al. | 53/492 |
| 4,846,455 | | 7/1989 | Hurst . | |
| 4,884,793 | | 12/1989 | Hurst . | |
| 4,915,369 | | 4/1990 | Rutishauser . | |
| 4,986,522 | | 1/1991 | Paulson . | |
| 5,022,638 | | 6/1991 | Ifkovits, Jr. . | |
| 5,026,340 | | 6/1991 | Thompson . | |
| 5,096,360 | * | 3/1992 | Nelson | 53/492 |
| 5,125,215 | | 6/1992 | Orsinger et al. . | |
| 5,131,643 | | 7/1992 | Graveson et al. . | |
| 5,139,250 | | 8/1992 | Zoltner . | |
| 5,149,076 | | 9/1992 | Stenz . | |
| 5,295,674 | | 3/1994 | Zeltner . | |
| 5,415,068 | | 5/1995 | Marzullo . | |
| 5,447,015 | * | 9/1995 | Belec et al. | 53/492 |
| 5,450,187 | * | 9/1995 | Pei et al. | 271/2 |
| 5,618,375 | | 4/1997 | Suzuki et al. . | |
| 5,715,648 | | 2/1998 | Yates . | |
| 5,722,221 | | 3/1998 | Maltman et al. . | |
| 5,729,954 | | 3/1998 | Lines et al. . | |
| 5,971,385 | * | 10/1999 | Belec | 271/2 |
| 6,036,185 | * | 3/2000 | Baumann et al. | 271/2 |

* cited by examiner

ENVELOPE PROCESSING APPARATUS

BACKGROUND OF THE INVENTION

1. Field of the Invention

The present invention deals with the field of devices for automatically processing envelopes. Particularly, this provides a device for automatically closing or opening the envelope closing flaps of envelopes of any size. Often it is desired to print, engrave, stamp or emboss on the closing flap of an envelope. When one of these activities is performed while the envelope is in the closed position often there is penetration to the front side of the envelope which is unacceptable. As such, it is common that envelope flaps are opened for printing and are then closed after printing for other processing or for distribution. This activity is often performed manually. The present invention provides a relatively small convenient apparatus which is portable and can be used for opening and/or closing the envelope closing flaps of various sized envelopes at various locations within a printing room. This eliminates the necessity of manually opening each flap prior to printing and manually closing each flap after printing or embossing or other marking of the envelope closing flap itself. One of the unique aspects of the present design is in the ability to close and/or open the closing flap of an envelope solely by changing the orientation of the stack of envelopes in the feed tray.

2. Description of the Prior Art

Numerous patents have been granted for the purposes of processing, forming, opening and closing and filling envelopes for various purposes such as U.S. Pat. No. 1,481,557 patented Jan. 22, 1924 to C. L. Post on an "Envelope Feeding Mechanism"; and U.S. Pat. No. 1,877,842 patented Sep. 20, 1932 to A. Gay and assigned to Multipost Co. on an "Envelope Handling Machine"; and U.S. Pat. No. 1,918,425 patented Jul. 18, 1933 to S. J. T. Price on an "Envelope Feeding Mechanism"; and U.S. Pat. No. 1,986,800 patented Jan. 8, 1935 to H. P. Elliott and assigned to the Elliott Addressing Machine Company on a "Card And Envelope Feeding Apparatus"; and U.S. Pat. No. 2,038,645 patented Apr. 28, 1936 to L. A. Cherry et al and assigned to H. W. Hilliard Co., Inc. on an "Envelope Feed Mechanism"; and U.S. Pat. No. 2,130,101 patented Sep. 13, 1938 to W. Ritzerfeld on an "Apparatus For Feeding Envelopes And Method Relating Thereto"; and U.S. Pat. No. 2,214,265 patented Sep. 10, 1940 to P. H. Wuille on an "Envelope Feeding Mechanism"; and U.S. Pat. No. 2,554,577 patented May 29, 1951 to J. R. Lauffer and assigned to Miller-Lauffer Printing Equipment Corp. on an "Envelope Feeder"; and U.S. Pat. No. 2,554,578 patented May 29, 1951 to J. R. Lauffer and assigned to Miller-Lauffer Printing Equipment Corp. on an "Envelope Feeding Machine"; and U.S. Pat. No. 3,175,822 patented Mar. 30, 1965 to H. A. Benson on a "Feeding Mechanism For Envelope Printing Press"; and U.S. Pat. No. 3,281,142 patented Oct. 25, 1966 to E. H. Treff and assigned to F. L. Smithe Machine Company, Inc. on a "Device For Feeding Envelope Blanks"; and U.S. Pat. No. 3,323,792 patented Jun. 6, 1967 to J. A. Hartzell on a "Method And Apparatus For Envelope Flap Extension"; and U.S. Pat. No. 3,450,307 patented Jun. 17, 1969 to C. O. Sutton assigned to The American Binder Company on an "Envelope Separator"; and U.S. Pat. No. 3,549,067 patented Dec. 22, 1970 to D. T. Robbins on an "Envelope Opening Machine"; and U.S. Pat. No. 3,583,124 patented Jun. 8, 1971 to W. J. Morrison and assigned to Bell & Howell Company on an "Envelope Flap Opening Apparatus And Method"; and U.S. Pat. No. 3,586,312 patented Jun. 22, 1971 to D. G. Sammons on an "Envelope Folder"; and U.S. Pat. No. 3,828,634 patented Aug. 13, 1974 to H. E. Luperti and assigned to Pitney-Bowes, Inc. on an "Automatic Envelope Opener"; and U.S. Pat. No. 4,020,615 patented May 3, 1977 to R. Irvine et al and assigned to Pitney-Bowes, Inc. on an "Envelope Inserter And Feeder System"; and U.S. Pat. No. 4,362,100 patented Dec. 7, 1982 to E. S. Wu et al and assigned to Wang Laboratories, inc. on an "Envelope Feeder"; and U.S. Pat. No. 4,371,157 patented Feb. 1, 1983 to R. E. Hunt et al and assigned to International Business Machines Corporation on a "Compact Envelope Handling Device"; and U.S. Pat. No. 4,431,323 patented Feb. 14, 1984 to H. H. Kulow and assigned to Kulow Products, Inc. on an "Envelope Feeder Method And Apparatus"; and U.S. Pat. No. 4,522,382 patented Jun. 11, 1985 to M. Chu et al and assigned to Primages, Inc. on a "Sheet And Envelope Feed Apparatus For A Printer And Associated Methods"; and U.S. Pat. No. 4,540,298 patented Sep. 10, 1985 to H. H. Kulow and assigned to Rowan Corporation on a "Manually Loaded Envelope Feeder"; and U.S. Pat. No. 4,603,846 patented Aug. 5, 1986 to K. Miles and assigned to Michael Miles, Alfred Dubler, Rick Diebold, David Dubler on a "Dual-Stream Envelope Feeder"; and U.S. Pat. No. 4,776,152 patented Oct. 11, 1988 to R. R. Kruk and assigned to Inscerco Mfg. Inc. on a "Method And Apparatus For Opening Envelope Flaps"; and U.S. Pat. No. 4,846,455 patented Jul. 11, 1989 to R. F. Hurst on a "High Speed Envelope Feeding Apparatus"; and U.S. Pat. No. 4,884,793 patented Dec. 5, 1989 to R. F. Hurst on a "Picker-Stripper-Feeder For Envelope Feeding Apparatus"; and U.S. Pat. No. 4,915,369 patented Apr. 10, 1990 to A. Rutishauser and assigned to Rutishauser Data AG on an "Apparatus For Separating And Feeding Envelopes To An Office Machine"; and U.S. Pat. No. 4,986,522 patented Jan. 22, 1991 to H. E. Paulson on a "Printing Press Feed Mechanism"; and U.S. Pat. No. 5,022,638 patented Jun. 11, 1991 to E. M. Ifkovits, Jr. and assigned to Pitney Bowes Inc. on an "Envelope Transporting Aligning And Stacking Module"; and U.S. Pat. No. 5,026,340 patented Jun. 25, 1991 to C. W. Thompson and assigned to Thompson Manufacturing Company, Inc. on a "Flap Closer"; and U.S. Pat. No. 5,125,215 patented Jun. 30, 1991 to W. A. Orsinger et al and assigned to Bell & Howell Phillipsburg Co. on an "Envelope Flap Opener"; and U.S. Pat. No. 5,131,643 patented Jul. 21, 1992 to S. J. Graveson et al and assigned to Pitney Bowes Inc. on a "Clamping Arm For Envelope Turner"; and U.S. Pat. No. 5,139,250 patented Aug. 18, 1992 to J. D. Zoltner and assigned to Xerox Corporation on an "Oscillating Blade Envelope Rotator"; and U.S. Pat. No. 5,149,076 patented Sep. 22, 1992 to R. Stenz on an "Envelope Feeder With Adjustable Constant Overlap"; and U.S. Pat. No. 5,295,674 patented Mar. 22, 1994 to J. D. Zoltner and assigned to Xerox Corporation on a "High Capacity Envelope Stacker Apparatus"; and U.S. Pat. No. 5,415,068 patented May 16, 1995 to J. H. Marzullo and assigned to Pitney Bowes Inc. on a "Multi-Function Envelope Feeder"; and U.S. Pat. No. 5,618,375 patented Apr. 8, 1997 to N. Suzuki et al and assigned to Juki Corporation on an "Envelope Processing Unit"; and U.S. Pat. No. 5,715,648 patented Feb. 10, 1998 to K. Yates and assigned to Pitney Bowes Inc. on an "Envelope Opening Apparatus"; and U.S. Pat. No. 5,722,221 patented Mar. 3, 1998 to R. D. Maltman et al and assigned to United States Computer Services on an "Envelope Opening Apparatus"; and U.S. Pat. No. 5,729,954 patented Mar. 24, 1998 to G. G. Lines et al and assigned to International Billing Services on an "Envelope Flap Opener Apparatus".

SUMMARY OF THE INVENTION

The present invention provides an envelope processing apparatus which automatically moves an envelope closing flap from a first position to a second position. The first position can be opened and moved to a close position or the first position can be closed and moved to an open position. The device includes a housing with a feed tray secured thereto which is adapted to hold envelopes therein for processing with the envelope closing flaps oriented in the first position. The feed tray is vertically adjustable with respect to the housing preferably.

An exit tray is also secured with respect to the housing and is adapted to receive envelopes therein after processing with the envelope closing flaps thereof moved to the new position. The exit tray is also preferably vertically adjustable with respect to the housing to facilitate placement of envelopes therein.

A main drive is preferably mounted in the housing and is secured with respect to a main drive pulley which is located and mounted within the housing and is operatively attached to this main drive to be rotatably powered for driving therewith. A first drive roller is rotatably mounted with respect to the housing as well as a second drive roller. These drive rollers are positioned adjacent to one another. They define therebetween a nip area for receiving and gripping envelopes to aid in guiding the movement of these envelopes between the first and second drive rollers to facilitate movement of the closing flap from the first position to the second position.

A main drive belt will be positioned extending about the main drive pulley such as to be rotatable therewith. This main drive belt will extend around the first drive roller for driving thereof in order to facilitate gripping of an envelope placed with the nip area and movement of this envelope between the first drive roller and the second drive roller.

A vacuum transfer assembly is included positioned between the feed tray and the first drive roller which is movable between a pick-up position in abutment with an envelope on the feed tray for removal thereof and a release position. The release position is designed for releasing the removed envelope into the nip area defined between the first and second drive rollers in order to facilitate gripping and movement therebetween.

In further detail the vacuum transfer assembly will preferably include a vacuum arm pivotally mounted with respect to the housing and extend outwardly therefrom. This vacuum arm will preferably be movable pivotally to allow movement thereof between the pick-up position and the release position. A vacuum cup device is secured to the vacuum arm and movable therewith. These vacuum cups will be normally shaped as suction cups and will be operative to selectively apply a vacuum therefrom for abutting and gripping an envelope from the feed tray responsive to the vacuum arm being at the pick-up position to cease applying of a vacuum therefrom in order to facilitate releasing into the nip area at the release position itself.

A link arm is preferably secured to the vacuum arm to facilitate urging pivotal movement thereof between the pick-up position and the release position. A connecting rod assembly is operatively and rotatably secured to the main drive pulley and is attached to the link arm to cause reciprocating movement of the vacuum transfer assembly between the pick-up position and the release position responsive to rotation of the drive pulley. Preferably the connecting rod assembly will include a spring member attached to the main drive pulley and the link arm to maintain tension therebetween as well as a connecting rod member rotatably attached to the main drive pulley and to the link arm for causing reciprocating movement of the vacuum arm between the pick-up position and the release position responsive to rotation of the main drive pulley means. The rotational movement of the main drive pulley will be transferred to the reciprocating motion by the connecting rod member. This connecting rod member also will preferably be longitudinally adjustable in order to facilitate control of this reciprocating movement of the vacuum arm between the pick-up position and the release position.

A vacuum control device will also be operative to apply vacuum to the vacuum cup or suction cup means for gripping of an envelope positioned in the feed tray means responsive to the vacuum transfer device being moved to the pick-up position. It is also operative to cease the application of vacuum to the vacuum cups responsive to movement of the vacuum transfer device to the release position for releasing of an envelope therefrom into the nip area defined between the first drive roller and the second drive roller.

In further detail this vacuum control device will include a valve operationally movable between an opened mode to supply vacuum and a closed mode to cease the application of vacuum. A vacuum line will be operatively connected between the valve and the vacuum cup in order to selectively supply vacuum to the vacuum cup responsive to the valve means being in the opened position. When this vacuum line is responsive to the valve means being in the closed position to cease the application of vacuum to the vacuum cup this initiation and cessation of the application of vacuum is controlled by a vacuum cam secured to the main drive pulley and movable therewith. The vacuum cam defines a cam profile thereon to facilitate control of the application of vacuum to the vacuum transfer assembly. A cam follower is also operationally attached with respect to the valve for controlling movement thereof between the opened position and the closed position. This cam follower is positioned continuously in abutment with respect to the cam profile of the vacuum cam for facilitating controlled operation of the valve means and full control of the application of vacuum therefrom.

A flap movement device is included which is adapted to generate a stream of air against the envelope closing flap of an envelope as it is placed into the nips area in order to move the envelope closing flap thereof from the first position to the second position. This is usable to move the envelope closing flap from the closed to the opened position or from the opened to the closed position. The flap movement device further includes a wedge positioned adjacent the nip area which is adapted to contact the envelope closing flap during movement thereof into the nip area to further urge movement thereof from the first position to the second position. The wedge preferably includes a laterally extending protruding edge which is adapted to contact the envelope closing flap as the envelope is moved into the nip area to facilitate movement thereof from the first position to the second position. The wedge defines an air outlet therein through which a stream of air is dispensed from the flap movement means in order to further urge movement of the envelope closing flap from the first position to the second position.

A delivery assembly is included mounted on the housing which is positioned adjacent to the first and second drive rollers and is operative for receiving envelopes therefrom. The delivery assembly then guides the movement of these envelopes toward the exit tray. In the preferred detail the delivery assembly includes a delivery panel positioned adjacent to the first and second drive rollers for receiving an envelope placed thereon after movement of the envelope flap from the first to the second station. The first delivery roller is rotatably mounted with respect to the housing adjacent to the first drive roller and is adapted to guide the received envelope into the panel. A second drive roller is rotatably mounted on the housing at a position adjacent the delivery panel opposite from the first delivery roller. A delivery conveyor belt extends preferably across the first delivery roller and the second delivery roller and across the delivery panel to facilitate conveying of envelopes over the delivery panel. This delivery roller is driven by the first delivery roller and is operative to drive the second delivery roller therewith.

A vertical orientation mechanism is also included positioned between the delivery assembly and the exit tray to receive envelopes from the delivery assembly and guide movement thereof to the exit tray in a generally vertical orientation. This vertical orientation device includes a first vertical roller positioned adjacent the delivery assembly and a second vertical roller position adjacent the delivery assembly and adjacent and generally below the first vertical roller. In this manner envelopes can be guided for movement downwardly therefrom into vertical orientation upon the exit tray. A vertical belt is also included extending around the first vertical roller and the second vertical roller in position and engagement with respect to the delivery assembly to be driven therewith. In this manner it will cause rotational movement of the first vertical roller and the second vertical roller. The vertical belt is also engageable with respect to an envelope moving from the delivery assembly toward the exit tray for facilitating placement thereof oriented vertically upon the tray itself.

It is an object of the present invention to provide an envelope processing apparatus for automatically moving an envelope closing flap from the first position to a second position.

It is an object of the present invention to provide an envelope processing apparatus for automatically moving an envelope closing flap from the opened position to a closed position.

It is an object of the present invention to provide an envelope processing apparatus for automatically moving an envelope closing flap from the closed position to an opened position.

It is an object of the present invention to provide an envelope processing apparatus for automatically moving an envelope closing flap from the first position to a second position wherein the number of moving parts is minimized.

It is an object of the present invention to provide an envelope processing apparatus for automatically moving an envelope closing flap from the first position to a second position wherein maintenance requirements are minimal at most.

It is an object of the present invention to provide an envelope processing apparatus for automatically moving an envelope closing flap from the first position to a second position wherein portability from one station to another throughout a printing room is possible.

It is an object of the present invention to provide an envelope processing apparatus for automatically moving an envelope closing flap from the first position to a second position wherein the same apparatus can be used for closing as well as opening envelope closing flaps by feeding envelopes through the device in the same direction but inverted.

It is an object of the present invention to provide an envelope processing apparatus for automatically moving an envelope closing flap from the first position to a second position wherein all rotational drive is taken from a single main drive pulley.

It is an object of the present invention to provide an envelope processing apparatus for automatically moving an envelope closing flap from the first position to a second position wherein vacuum is utilized for transfer one at a time from a stack at a feed location for closing of the flap and then transfer thereof to the exit location.

It is an object of the present invention to provide an envelope processing apparatus for automatically moving an envelope closing flap from the first position to a second position wherein closed envelopes are loaded into a feed tray inverted with the closing flaps facing away from the apparatus for processing and for opening.

It is an object of the present invention to provide an envelope processing apparatus for automatically moving an envelope closing flap from the first position to a second position wherein open envelopes are loaded into a feed tray with the flaps extending outwardly and the envelopes stacked in the upright position for processing and closing of the closing flaps by the apparatus.

It is an object of the present invention to provide an envelope processing apparatus for automatically moving an envelope closing flap from the first position to a second position wherein usage with variable sized envelopes is made possible by an adjustment means provided in the feed tray and in the exit tray for varying the spacing thereof from the other working parts of the envelope processing apparatus.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

The present invention provides an apparatus for processing envelopes 10 by changing the orientation of the envelope closing flap 12 between an opened position 14 and a closed position 16. This apparatus is operable to change the envelope closing flap 12 from the opened position 14 to the closed position 16 or, alternatively, from the closed position 16 to the opened position 14. To change the mode of operation there is no alterations need be performed on the apparatus itself. It only is necessary that the envelopes be loaded at a modified orientation.

Figure 1:
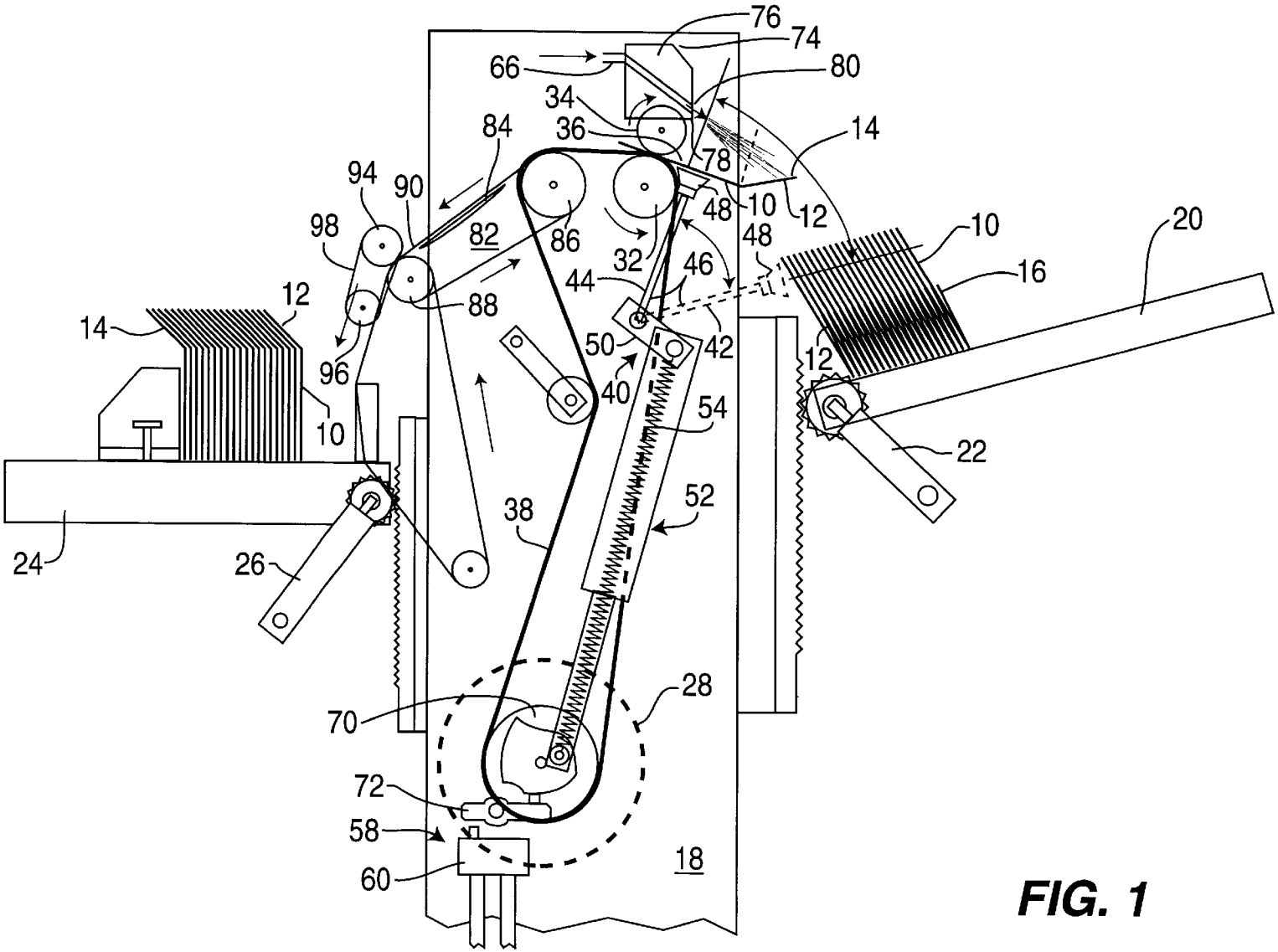
FIG. 1 is a schematic illustration of an embodiment of the apparatus of the present invention as shown in the process of opening the envelope closing flap of closed envelopes.

The processing apparatus includes a housing 18 with a feed tray 20 at the input end thereof and an exit tray 24 at the output end thereof. Envelopes 10 to be processed are placed into the feed tray 20 and are picked up by the apparatus with the envelope closing flap 12 being moved to a new position and are then fed to an exit tray 24 for removal. Positioning of the feed tray 20 with respect to a housing 18 can be varied by a feed tray adjustment means 22 such as a rack and pinion crank as shown in FIG. 1. Similarly the positioning of the exit tray 24 with respect to the housing 18 can be modified by adjusting of the exit tray adjustment mechanism 26. Exit tray adjustment capability 26 is also shown in FIG. 1 as a rack and pinion gear mechanism operable through manual rotation of a handle.

A main drive 28 is included in the present invention mounted within the housing 18 and includes a main drive pulley 30 rotationally driven thereby. A main drive belt 38 extends about the main drive pulley 30 to be driven thereby. Main drive belt 38 also extends around other important rollers in the apparatus of the present invention for powering thereof as described below.

A first drive roller 32 and a second drive roller 34 are positioned adjacent to one another and are rotatably mounted within the housing 18. The first drive roller 32 is preferably operatively engaged with respect to the main drive belt 38 to be driven thereby. A nip area 36 is defined between the first drive roller 32 and the second drive roller 34 and is adapted to receive and grasp an envelope 10 placed therein for processing.

Envelopes 10 are moved from the feed tray 20 to the nip area 36 by a vacuum transfer assembly 40. Vacuum transfer assembly 40 is operable to move the individual envelope 10 from the pick-up position 42 at the feed tray 20 to the release position 44 within the nip area 36.

To achieve this transfer the vacuum transfer assembly 40 includes preferably a vacuum arm 46 pivotally movable with respect to the housing 18 which includes a vacuum cup or vacuum suction cup device 48 positioned thereon. As the vacuum arm 46 moves to the pick-up position 42 the vacuum cup 48 will be brought into abutment with an envelope 10 positioned on the feed tray 20. Thereafter vacuum will be supplied to the vacuum cup 48 such that it grasps this envelope. Thereafter the vacuum arm 46 will be pivoted to the release position 44 adjacent the nip area 36 with the envelope 10 positioned for insertion between the first drive roller 32 and the second drive roller 34.

Operation of the pivotal movement of the vacuum arm is controlled through a link arm 50 secured thereto. Link arm 50 is movably secured with respect to a connecting rod assembly 52 which in turn is operatively and rotatably attached preferably with respect to the main drive pulley 30. As the main drive pulley 30 rotates the connecting rod assembly 52 will convert this rotational motion into reciprocating motion through connections of a link arm 50 to urge movement of the vacuum arm 46 between the pick-up position 42 and the release position 44.

The specific preferred configuration for the connecting rod assembly 52 includes a spring 54 for maintaining tension between the link arm 50 and the main drive pulley 30 and a connecting rod member 56 which is pivotally secured to the main drive pulley 30 and is pivotally secured with respect to the link arm 50. This connecting rod member 56 is preferably longitudinally extensible and retractable by adjustment to vary the relative operational characteristics between the connecting rod assembly 52 and the vacuum transfer assembly 40 and, in particular, the vacuum arm means 46 thereof.

Figure 3:
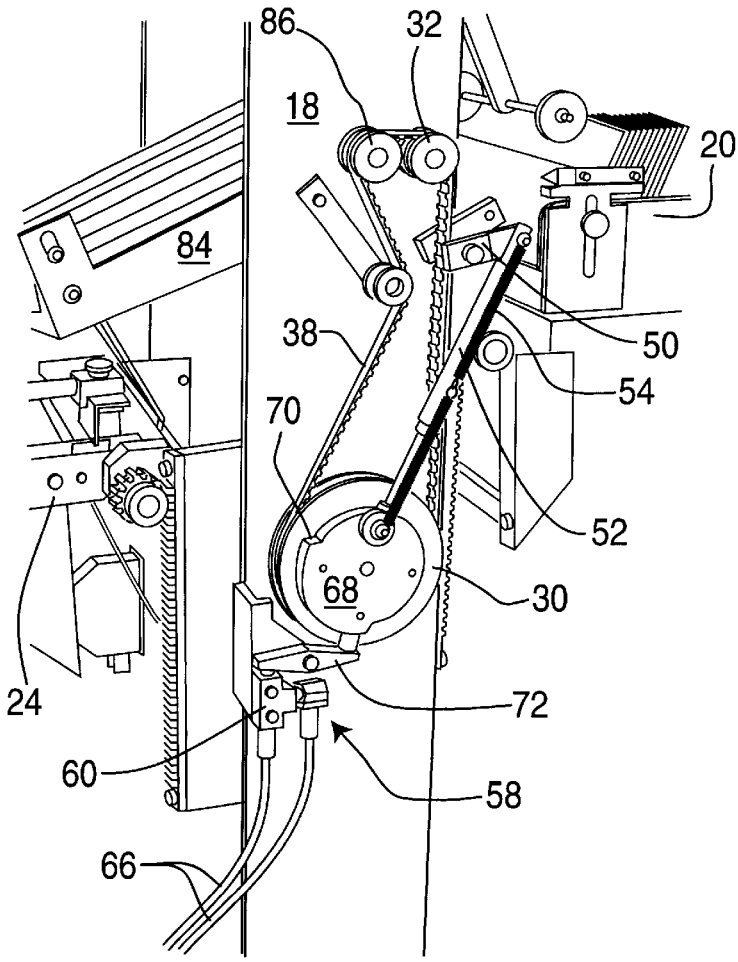
FIG. 3 is a perspective illustration highlighting the drive mechanism of the present invention.
Figure 4:
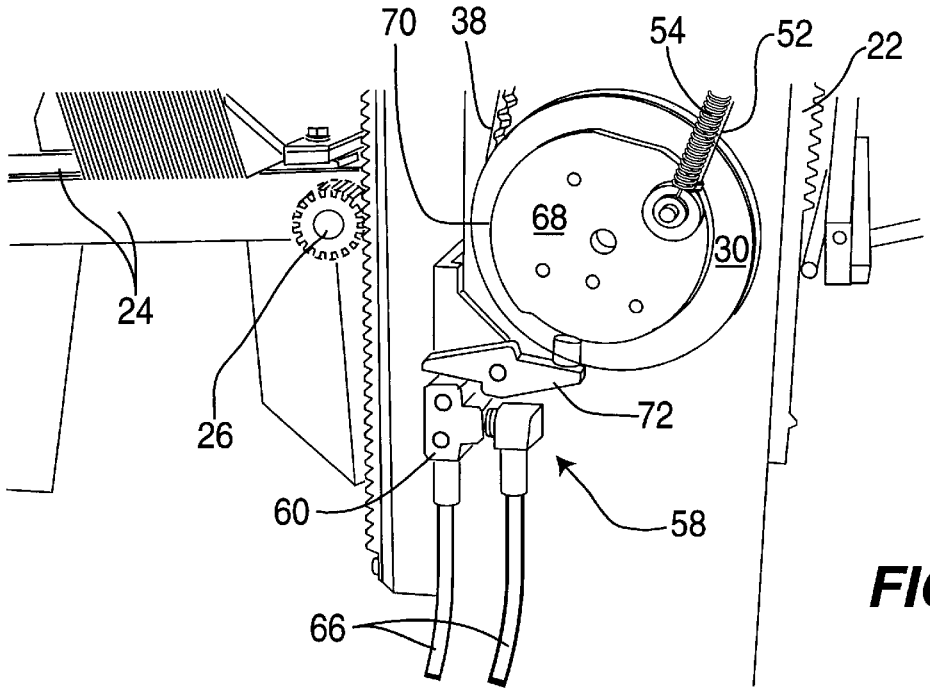
FIG. 4 is a view of an embodiment of the camming and vacuum valve configuration of the present invention.
Figure 5:
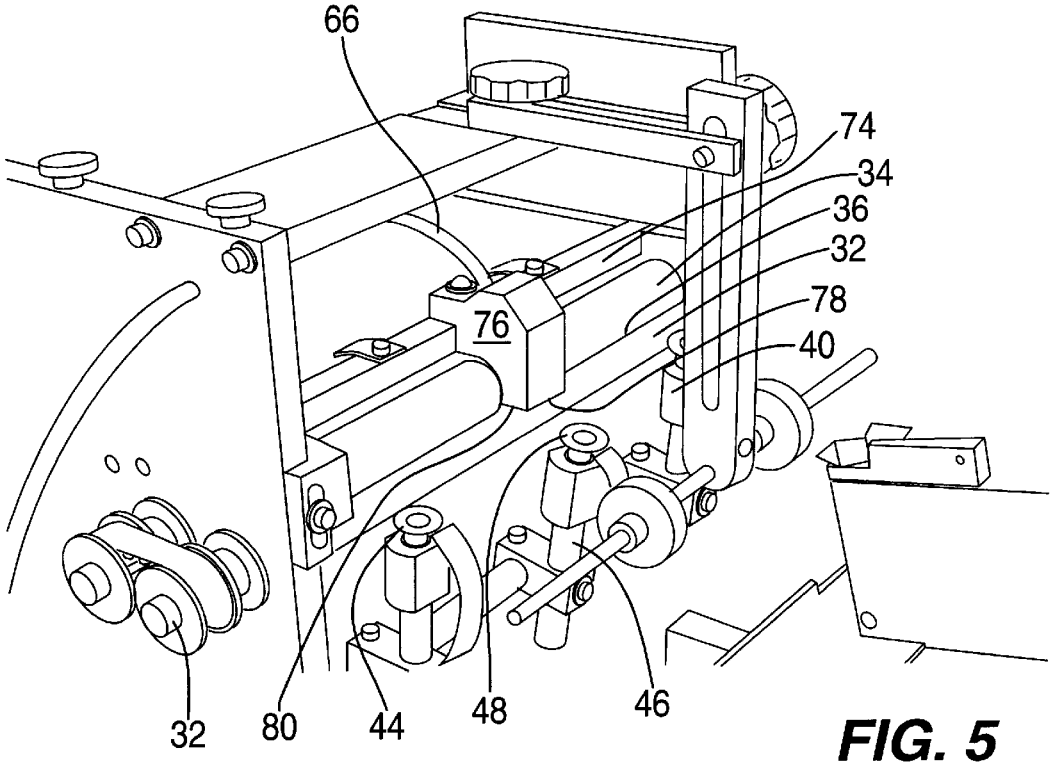
FIG. 5 is a perspective illustration of an embodiment of the flap movement means of the present invention.
Figure 6:
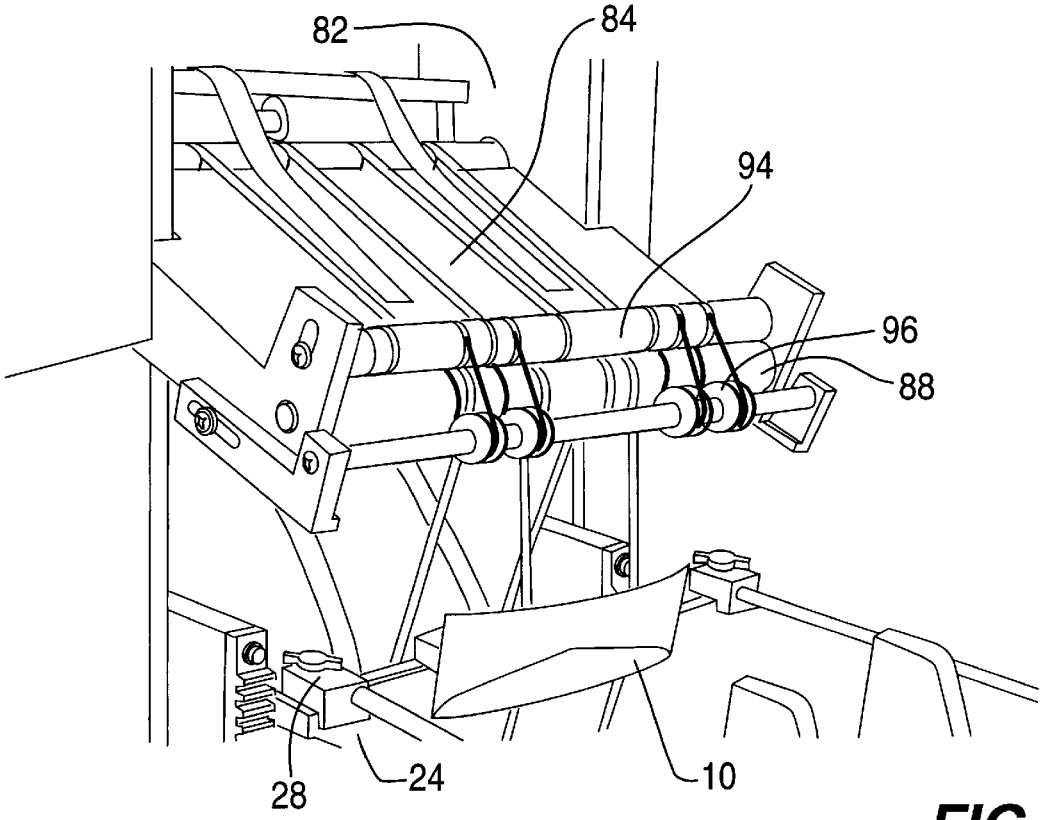
FIG. 6 is a close-up view of an embodiment of the delivery assembly and exit tray of the present invention.

A vacuum control means 58 is further included for controlling the application of vacuum to the vacuum cups 48. This vacuum control means preferably includes a vacuum valve 60 operatively connected through a vacuum line 66 to the vacuum cup 48. Vacuum is selectively applied or denied through the vacuum line 66 based on the positioning of the valve means. When the valve means 60 is in the opened position vacuum is applied to the vacuum cups 48. When the valve 60 is in the closed position vacuum is not so applied. Movement of the valve 60 between the opened and closed positions is controlled by a vacuum cam 68 shown best in FIGS. 3 and 4. Cam follower 72 is pivotally movable and is operative to open or close the valve 60. Cam follower 72 is in continuous contact with a cam profile 70 defined on the vacuum cam 68 which is fixedly secured to the main drive pulley 30.

A flap movement means 74 is very important to the present invention and is designed to alter the positioning of the envelope closing flap 12 as the vacuum arm 46 is moved toward the release position 44 thereof. This flap movement means 74 preferably includes a wedge 76 which includes a laterally extending protruding edge 78 adapted to contact the envelope closing flap 12 for movement thereof from the first position to the second position. To further facilitate changing of positioning of the envelope closing flap 12 an air outlet 80 will be included in the wedge 76 which is adapted to deliver a stream or burst of air against the envelope closing flap 12 to facilitate movement thereof from the first position to the second position.

Figure 2:
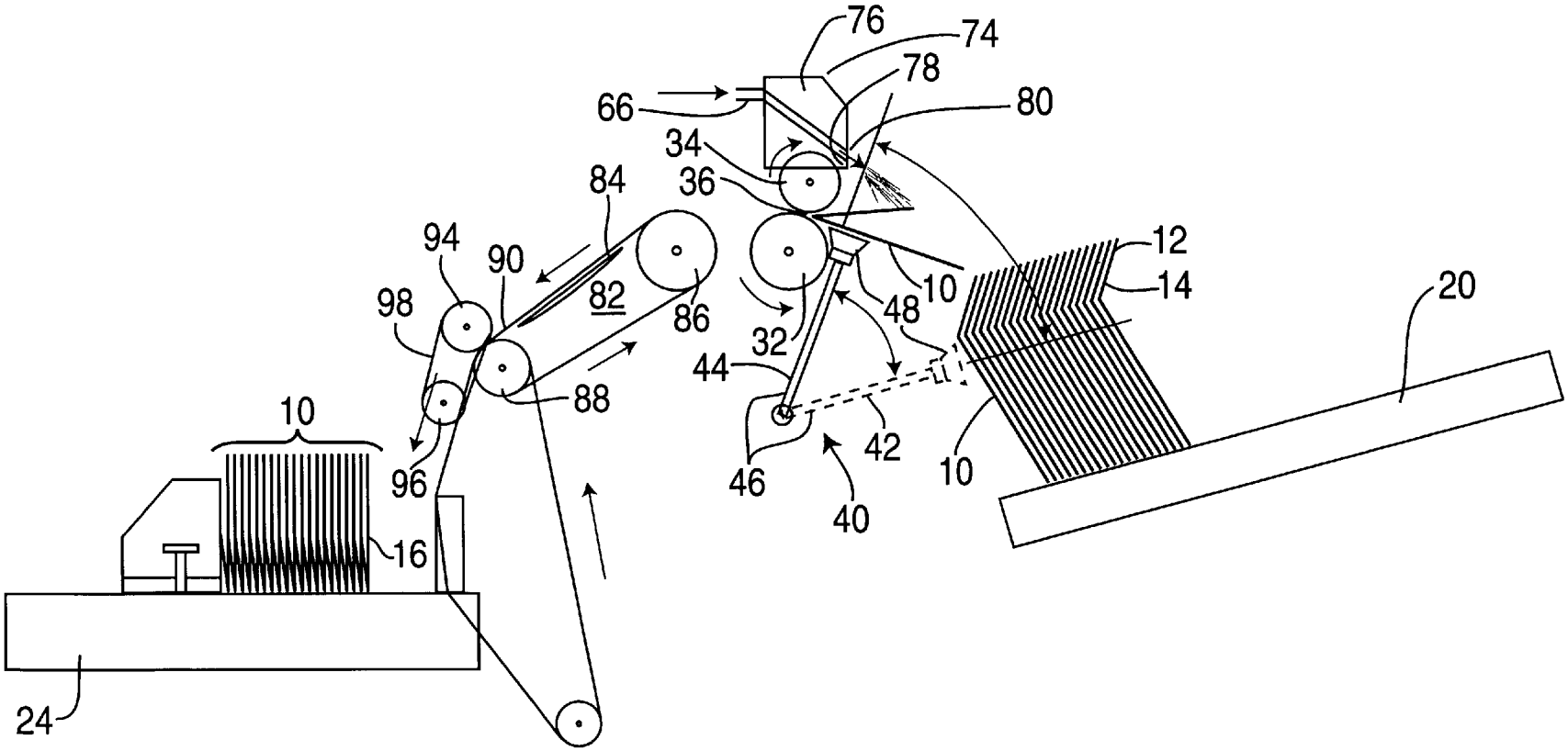
FIG. 2 is a schematic illustration of a portion of the embodiment shown in FIG. 1 with the apparatus shown closing opened envelopes.

As shown in FIG. 1 the laterally extending protruding edge 78 will contact the underside of the envelope closing flap 12 of a closed envelope to initiate opening thereof. The burst of air generated through the air outlet 80 will then move the envelope closing flap 12 to the completely opened position by the exertion of a burst of air between the envelope itself and the undersurface of the envelope closing flap 12. Alternatively, in the FIG. 2 configuration with the envelope closing flap 12 in the opened position, the laterally extending protruding edge 78 of the wedge 76 and the burst of air from the air outlet means 80 will be exerted upon the outer surface of the envelope closing flap 12 for causing same to move to the closed position 16. This is a unique aspect of the present invention wherein the same identical apparatus is useful for performing both the opening and closing operation and wherein the change of mode of operation is achieved solely by modifying the loading orientation from inverted to upright or vice versa.

Once the processed envelope 10 passes between the first drive roller 32 and the second drive roller 34 it is received by a delivery assembly 82. Delivery assembly 82 is operative to deliver the processed envelope 10 to the exit tray 24. Delivery assembly 82 includes preferably in detail a delivery panel 84 extending slightly downwardly from the location of the first and second drive rollers 32 and 34. Delivery assembly 82 preferably also includes a first delivery roller 86 at one end of the panel 84 and a second delivery roller 88 at the opposite end of the delivery panel 84. A delivery conveying belt 90 extends around the first delivery roller 86 and the second delivery roller 88 to facilitate the conveying and delivery of envelopes positioned upon the delivery panel 84. In the preferred configuration the first delivery roller 86 is positioned closer to the first and second delivery rollers 32 and 34 than the second delivery roller 88. Also the second delivery roller 88 is positioned closer to the exit tray 24 than the first delivery roller 86.

In order to enhance the gathering of the envelopes 10 upon the exit tray 24 a vertical orientation means 92 may be included. This vertical orientation means 92 has the purpose of achieving approximately vertical orientation of all envelopes discharged from the delivery assembly 82 onto the exit tray 24. In detail preferably the vertical orientation means 92 includes a first vertical roller 94 with a second vertical roller 96 positioned slightly therebelow. A vertical belt 96 is connected between the first and second vertical rollers 94 and 96 for interconnecting operative driving therebetween.

All driving of roller movement in the apparatus of the present invention is achieved through the main drive belt 38. This drive belt extends about the main drive pulley 30 as well as the first drive roller 32. The first drive roller 32 is in engagement with respect to the second drive roller 34 for driving thereof. The main drive belt 38 also drives the first delivery roller 86 of the delivery assembly 82. First delivery roller 86 is operative to drive the second delivery roller 88 since the delivery conveying belt 90 extends about both rollers. In the preferred configuration of the vertical orientation means the vertical belt 98 extending between the first vertical roller 94 and the second vertical roller 96 will be in engagement with respect to the second delivery roller 88 of the delivery assembly 82 in order to be driven therewith.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An envelope processing apparatus for automatically moving an envelope closing flap from a first position to a second position, namely from an opened position to a closed position and vice versa, which comprises:

A. a housing means;

B. a feed tray means secured to said housing means and adapted to hold envelopes therein for processing with the envelope closing flaps positioned in a first position thereon;

C. an exit tray means secured with respect to said housing means and adapted to receive envelopes therein after processing with the envelope closing flaps thereof moved to the second position;

D. a main drive means secured to said housing means;

E. a main drive pulley means rotatably mounted to said housing means and operatively attached to said main drive means to be rotatably driven therewith:

F. a first drive roller means rotatably mounted with respect to said housing means;

G. a second drive roller means positioned adjacent to said first drive roller means and being rotatable therewith with respect to said housing means, said first drive roller means and said second drive roller means defining therebetween a nip area for receiving and gripping envelopes to facilitate guiding movement thereof therebetween and to facilitate movement of the envelope closing flap from the first position to the second position;

H. a main drive belt means extending about said main drive pulley means and being rotatable therewith, said main drive belt means also extending around said first drive roller means for driving thereof to facilitate gripping of an envelope placed within said nip area and movement thereof between said first drive roller means and said second drive roller means;

I. a vacuum transfer assembly positioned between said feed tray means and said first drive roller means and being movable between a pick-up position in abutment with an envelope on said feed tray means for removal thereof and a release position for releasing the removed envelope into said nip area defined between said first and second drive roller means for gripping and movement of said envelopes therebetween; and J. a flap movement means adapted to generate a stream of air against an envelope closing flap as an envelope is placed into said nip area in order to move the envelope closing flap thereof from the first position to the second position; and K. a delivery assembly mounted with respect to said housing means and positioned adjacent said first and second drive roller means and operative to receive an envelope therefrom for guiding movement thereof toward said exit tray means.

2. An envelope processing apparatus for automatically moving an envelope closing flap from a first position to a second position, namely from an opened position to a closed position and vice versa, as defined in claim 1 wherein said flap movement means further includes a wedge means positioned adjacent said nip area which is adapted to contact the envelope closing flap during movement thereof into said nip area to further urge movement thereof from the first position to the second position thereof.

3. An envelope processing apparatus for automatically moving an envelope closing flap from a first position to a second position, namely from an opened position to a closed position and vice versa, as defined in claim 2 wherein said wedge means includes a laterally extending protruding edge adapted to contact an envelope closing flap as an envelope is moved into said nip area to facilitate movement thereof from the first position to the second position.

4. An envelope processing apparatus for automatically moving an envelope closing flap from a first position to a second position, namely from an opened position to a closed position and vice versa, as defined in claim 2 wherein said wedge means defines an air outlet means therein through which a stream of air is dispensed from said flap movement means to further urge movement of said envelope closing flap from the first position to the second position thereof.

5. An envelope processing apparatus for automatically moving an envelope closing flap from a first position to a second position, namely from an opened position to a closed position and vice versa, as defined in claim 1 wherein said vacuum transfer assembly includes:

A. a vacuum arm means pivotally mounted with respect to said housing means and extending outwardly therefrom, said vacuum arm means being movable pivotally to allow movement thereof between the pick-up position and the release position; and B. a vacuum cup means secured to said vacuum arm means and movable therewith, said vacuum cup means being operative to selectively apply vacuum therefrom for abutting and gripping an envelope from said feed tray means responsive to said vacuum arm means being at the pick-up position and to cease applying of a vacuum therefrom to facilitate releasing thereof into said nip area at the release position.

6. An envelope processing apparatus for automatically moving an envelope closing flap from a first position to a second position, namely from an opened position to a closed position and vice versa, as defined in claim 5 wherein said vacuum transfer assembly further includes a link arm means secured to said vacuum arm means for urging pivotal movement thereof between the pick-up position and the release position.

7. An envelope processing apparatus for automatically moving an envelope closing flap from a first position to a second position, namely from an opened position to a closed position and vice versa, as defined in claim 6 wherein said vacuum transfer assembly further includes a connecting rod assembly operatively and rotatably secured to said main drive pulley means and attached to said link arm means to cause reciprocating movement of said vacuum transfer assembly between the pick-up position and the release position responsive to rotation of said drive pulley means.

8. An envelope processing apparatus for automatically moving an envelope closing flap from a first position to a second position, namely from an opened position to a closed position and vice versa, as defined in claim 7 wherein said connecting rod assembly includes:

A. a spring means attached to said main drive pulley means and to said link arm means to maintain tension therebetween; and B. a connecting rod member rotatably attached to said main drive pulley means and to said link arm means for causing reciprocating movement of said vacuum arm means between the pick-up position and the release position responsive to rotation of said main drive pulley means.

9. An envelope processing apparatus for automatically moving an envelope closing flap from a first position to a second position, namely from an opened position to a closed position and vice versa, as defined in claim 8 wherein said connecting rod member is longitudinally adjustable in length to facilitate control of reciprocating movement of said vacuum arm means between the pick-up position and the release position responsive to rotation of said main drive pulley means.

10. An envelope processing apparatus for automatically moving an envelope closing flap from a first position to a second position, namely from an opened position to a closed position and vice versa, as defined in claim 5 wherein said vacuum transfer assembly further includes a vacuum control means operative to apply vacuum to said vacuum cup means for gripping of an envelope positioned in said feed tray means responsive to said vacuum transfer means being moved to the pick-up position and being operative to cease the application of vacuum to said vacuum cup means responsive to movement of said vacuum transfer means to the release position for releasing of an envelope therefrom into said nip area defined between said first drive roller means and said second drive roller means.

11. An envelope processing apparatus for automatically moving an envelope closing flap from a first position to a second position, namely from an opened position to a closed position and vice versa, as defined in claim 10 wherein said vacuum control means includes:

A. a valve means operationally movable between an opened mode to supply vacuum and a closed mode to cease application of vacuum; and B. a vacuum line operatively connected between said valve means and to said vacuum cup means to selectively supply vacuum to said vacuum cup means responsive to said valve means being in the opened position and being responsive to said valve means being in the closed position to cease supplying of vacuum to said vacuum cup means.

12. An envelope processing apparatus for automatically moving an envelope closing flap from a first position to a second position, namely from an opened position to a closed position and vice versa, as defined in claim 11 wherein said vacuum transfer assembly further includes:

A. a vacuum cam means secured to said main drive pulley means and movable therewith, said vacuum cam means defining a cam profile means thereon to facilitate control the application of vacuum to said vacuum transfer assembly; and B. a cam follower means operationally attached with respect to said valve means for controlling movement thereof between the opened mode and the closed mode, said cam follower positioned continuously in abutment with respect to said cam profile means of said vacuum cam means for facilitating controlling operation of said valve means.

13. An envelope processing apparatus for automatically moving an envelope closing flap from a first position to a second position, namely from an opened position to a closed position and vice versa, as defined in claim 1 further including a vertical orientation means positioned between said delivery assembly and said exit tray means to receive envelopes from said delivery assembly and guide movement thereof onto said exit tray means in a generally vertical orientation.

14. An envelope processing apparatus for automatically moving an envelope closing flap from a first position to a second position, namely from an opened position to a closed position and vice versa, as defined in claim 13 wherein said vertical orientation means comprises:

A. a first vertical roller means positioned adjacent said delivery assembly; and B. a second vertical roller means positioned adjacent said delivery assembly and adjacent and generally below said first vertical roller means for guiding movement of envelopes downwardly therefrom into vertical orientation upon said exit tray means; and C. a vertical belt means extending around said first vertical roller means and said second vertical roller means and in engagement with respect to said delivery assembly to be driven therewith and to cause rotational movement of said first vertical roller means and said second vertical roller means, said vertical belt means being engageable with respect to an envelope moving from said delivery assembly toward said exit tray means for facilitating orienting thereof vertically upon said exit tray means.

15. An envelope processing apparatus for automatically moving an envelope closing flap from a first position to a second position, namely from an opened position to a closed position and vice versa, as defined in claim 1 wherein said feed tray means is vertically adjustable with respect to said housing means to facilitate removable of envelopes therefrom by said vacuum transfer assembly.

16. An envelope processing apparatus for automatically moving an envelope closing flap from a first position to a second position, namely from an opened position to a closed position and vice versa, as defined in claim 1 wherein said exit tray means is vertically adjustable with respect to said housing means to facilitate placement of envelopes thereon by said vacuum transfer assembly.

17. An envelope processing apparatus for automatically moving an envelope closing flap from a first position to a second position, namely from an opened position to a closed position and vice versa, as defined in claim 1 wherein said delivery assembly comprises:

A. a delivery panel means positioned adjacent said first drive roller and said second drive roller and being adapted to receive an envelope after moving therebetween;

B. a first delivery roller rotatably mounted to said housing means at a position adjacent said first drive roller and being adapted to guide an envelope exiting from between said first and second guide rollers onto said delivery panel means;

C. a second delivery roller rotatably mounted to said housing means at a position adjacent said delivery panel means opposite from said first delivery roller; and D. a delivery conveying belt extending around said first delivery roller and said second delivery roller and extending across said delivery panel means to facilitate conveying of envelopes over said delivery panel means.

18. An envelope processing apparatus for automatically moving an envelope closing flap from a first position to a second position, namely from an opened position to a closed position and vice versa, as defined in claim 17 wherein said first delivery roller is operatively engaged with respect to said main drive belt to be rotatably therewith.

19. An envelope processing apparatus for automatically moving an envelope closing flap from a first position to a second position, namely from an opened position to a closed position and vice versa, which comprises:

A. a housing means;

B. a feed tray means secured to said housing means and adapted to hold envelopes therein for processing with the envelope closing flaps positioned in a first position thereon;

C. an exit tray means secured with respect to said housing means and adapted to receive envelopes therein after processing with the envelope closing flaps thereof moved to the second position;

D. a main drive means secured to said housing means;

E. a main drive pulley means rotatably mounted to said housing means and operatively attached to said main drive means to be rotatably driven therewith:

F. a first drive roller means rotatably mounted with respect to said housing means;

G. a second drive roller means positioned adjacent to said first drive roller means and being rotatable therewith with respect to said housing means, said first drive roller means and said second drive roller means defining therebetween a nip area for receiving and gripping envelopes to facilitate guiding movement thereof therebetween and to facilitate movement of the envelope closing flap from the first position to the second position;

H. a main drive belt means extending about said main drive pulley means and being rotatable therewith, said main drive belt means also extending around said first drive roller means for driving thereof to facilitate gripping of an envelope placed within said nip area and movement thereof between said first drive roller means and said second drive roller means;

I. a vacuum transfer assembly positioned between said feed tray means and said first drive roller means and being movable between a pick-up position in abutment with an envelope on said feed tray means for removal thereof and a release position for releasing the removed envelope into said nip area defined between said first and second drive roller means for gripping and movement of said envelopes therebetween, said vacuum transfer assembly including:

(1) a vacuum arm means pivotally mounted with respect to said housing means and extending outwardly therefrom, said vacuum arm means being movable pivotally to allow movement thereof between the pick-up position and the release position;

(2) a vacuum cup means secured to said vacuum arm means and movable therewith, said vacuum cup means being operative to selectively apply vacuum therefrom for abutting and gripping an envelope from said feed tray means responsive to said vacuum arm means being at the pick-up position and to cease applying of a vacuum therefrom to facilitate releasing thereof into said nip area at the release position;

(3) a link arm means secured to said vacuum arm means for urging pivotal movement thereof between the pick-up position and the release position;

(4) a connecting rod assembly operatively and rotatably secured to said main drive pulley means and attached to said link arm means to cause reciprocating movement of said vacuum transfer assembly between the pick-up position and the release position responsive to rotation of said drive pulley means, said connecting rod assembly including:

(a) a spring means attached to said main drive pulley means and to said link arm means to maintain tension therebetween;

(b) a connecting rod member rotatably attached to said main drive pulley means and to said link arm means for causing reciprocating movement of said vacuum arm means between the pick-up position and the release position responsive to rotation of said main drive pulley means, said connecting rod member being longitudinally adjustable in length to facilitate control of reciprocating movement of said vacuum arm means between the pick-up position and the release position responsive to rotation of said main drive pulley means;

J. a flap movement means adapted to generated a stream of air against an envelope closing flap as an envelope is placed into said nip area in order to move the envelope closing flap thereof from the first position to the second position, said flap movement means further including a wedge means positioned adjacent said nip area which is adapted to contact the envelope closing flap during movement thereof into said nip area to further urge movement thereof from the first position to the second position thereof, said wedge means including a laterally extending protruding edge adapted to contact an envelope closing flap as an envelope is moved into said nip area to facilitate movement thereof from the first position to the second position, said wedge means defining an air outlet means therein through which a stream of air is dispensed from said flap movement means to further urge movement of said envelope closing flap from the first position to the second position thereof; and K. a delivery assembly mounted with respect to said housing means and positioned adjacent said first and second drive roller means and operative to receive an envelope therefrom for guiding movement thereof toward said exit tray means.

20. An envelope processing apparatus for automatically moving an envelope closing flap from a first position to a second position, namely from an opened position to a closed position and vice versa, which comprises:

A. a housing means;

B. a feed tray means secured to said housing means and adapted to hold envelopes therein for processing with the envelope closing flaps positioned in a first position thereon, said feed tray means being vertically adjustable with respect to said housing means;

C. an exit tray means secured with respect to said housing means and adapted to receive envelopes therein after processing with the envelope closing flaps thereof moved to the second position, said exit tray means being vertically adjustable with respect to said housing means;

D. a main drive means secured to said housing means;

E. a main drive pulley means rotatably mounted to said housing means and operatively attached to said main drive means to be rotatably driven therewith:

F. a first drive roller means rotatably mounted with respect to said housing means;

G. a second drive roller means positioned adjacent to said first drive roller means and being rotatable therewith with respect to said housing means, said first drive roller means and said second drive roller means defining therebetween a nip area for receiving and gripping envelopes to facilitate guiding movement thereof therebetween and to facilitate movement of the envelope closing flap from the first position to the second position;

H. a main drive belt means extending about said main drive pulley means and being rotatable therewith, said main drive belt means also extending around said first drive roller means for driving thereof to facilitate gripping of an envelope placed within said nip area and movement thereof between said first drive roller means and said second drive roller means;

I. a vacuum transfer assembly positioned between said feed tray means and said first drive roller means and being movable between a pick-up position in abutment with an envelope on said feed tray means for removal thereof and a release position for releasing the removed envelope into said nip area defined between said first and second drive roller means for gripping and movement of said envelopes therebetween, said vacuum transfer assembly including:

(1) a vacuum arm means pivotally mounted with respect to said housing means and extending outwardly therefrom, said vacuum arm means being movable pivotally to allow movement thereof between the pick-up position and the release position;

(2) a vacuum cup means secured to said vacuum arm means and movable therewith, said vacuum cup means being operative to selectively apply vacuum therefrom for abutting and gripping an envelope from said feed tray means responsive to said vacuum arm means being at the pick-up position and to cease applying of a vacuum therefrom to facilitate releasing thereof into said nip area at the release position;

(3) a link arm means secured to said vacuum arm means for urging pivotal movement thereof between the pick-up position and the release position;

(4) a connecting rod assembly operatively and rotatably secured to said main drive pulley means and attached to said link arm means to cause reciprocating movement of said vacuum transfer assembly between the pick-up position and the release position responsive to rotation of said drive pulley means, said connecting rod assembly including:

(a) a spring means attached to said main drive pulley means and to said link arm means to maintain tension therebetween;

(b) a connecting rod member rotatably attached to said main drive pulley means and to said link arm means for causing reciprocating movement of said vacuum arm means between the pick-up position and the release position responsive to rotation of said main drive pulley means, said connecting rod member being longitudinally adjustable in length to facilitate control of reciprocating movement of said vacuum arm means between the pick-up position and the release position responsive to rotation of said main drive pulley means;

(5) a vacuum control means operative to apply vacuum to said vacuum cup means for gripping of an envelope positioned in said feed tray means responsive to said vacuum transfer means being moved to the pick-up position and being operative to cease the application of vacuum to said vacuum cup means responsive to movement of said vacuum transfer means to the release position for releasing of an envelope therefrom into said nip area defined between said first drive roller means and said second drive roller means, said vacuum control means including:

(a) a valve means operationally movable between an opened mode to supply vacuum and a closed mode to cease application of vacuum;

(b) a vacuum line operatively connected between said valve means and to said vacuum cup means to selectively supply vacuum to said vacuum cup means responsive to said valve means being in the opened position and being responsive to said valve means being in the closed position to cease supplying of vacuum to said vacuum cup means;

(c) a vacuum cam means secured to said main drive pulley means and movable therewith, said vacuum cam means defining a cam profile means thereon to facilitate control the application of vacuum to said vacuum transfer assembly;

(d) a cam follower means operationally attached with respect to said valve means for controlling movement thereof between the opened mode and the closed mode, said cam follower positioned continuously in abutment with respect to said cam profile means of said vacuum cam means for facilitating controlling operation of said valve means;

J. a flap movement means adapted to generated a stream of air against an envelope closing flap as an envelope is placed into said nip area in order to move the envelope closing flap thereof from the first position to the second position, said flap movement means further including a wedge means positioned adjacent said nip area which is adapted to contact the envelope closing flap during movement thereof into said nip area to further urge movement thereof from the first position to the second position thereof, said wedge means including a laterally extending protruding edge adapted to contact an envelope closing flap as an envelope is moved into said nip area to facilitate movement thereof from the first position to the second position, said wedge means defining an air outlet means therein through which a stream of air is dispensed from said flap movement means to further urge movement of said envelope closing flap from the first position to the second position thereof;

K. a delivery assembly mounted with respect to said housing means and positioned adjacent said first and second drive roller means and operative to receive an envelope therefrom for guiding movement thereof toward said exit tray means, said delivery assembly comprising:

(1) a delivery panel means positioned adjacent said first drive roller and said second drive roller and being adapted to receive an envelope after moving therebetween;

(2) a first delivery roller rotatably mounted to said housing means at a position adjacent said first drive roller and being adapted to guide an envelope exiting from between said first and second guide rollers onto said delivery panel means, said first delivery roller being operatively engaged with respect to said main drive belt to be rotatably therewith;

(3) a second delivery roller rotatably mounted to said housing means at a position adjacent said delivery panel means opposite from said first delivery roller;

(4) a delivery conveying belt extending around said first delivery roller and said second delivery roller and extending across said delivery panel means to facilitate conveying of envelopes over said delivery panel means, said delivery conveying belt being driven by said first delivery roller and operative to drive said second delivery roller;

L. a vertical orientation means positioned between said delivery assembly and said exit tray means to receive envelopes from said delivery assembly and guide movement thereof onto said exit tray means in a generally vertical orientation, said vertical orientation means comprising:

(1) a first vertical roller means positioned adjacent said delivery assembly;

(2) a second vertical roller means positioned adjacent said delivery assembly and adjacent and generally below said first vertical roller means for guiding movement of envelopes downwardly therefrom into vertical orientation upon said exit tray means; and (3) a vertical belt means extending around said first vertical roller means and said second vertical roller means and in engagement with respect to said delivery assembly to be driven therewith and to cause rotational movement of said first vertical roller means and said second vertical roller means, said vertical belt means being engageable with respect to an envelope moving from said delivery assembly toward said exit tray means for facilitating orienting thereof vertically upon said exit tray means.

* * * * *